US005292565A

United States Patent [19]

Napier et al.

[11] Patent Number: 5,292,565

[45] Date of Patent: Mar. 8, 1994

[54] INK ROLL FOR HIGH SPEED PRINTING

[75] Inventors: Lisa A. Napier; Stephanie S. Hinton, both of Cookeville; Sherron F. Stanton, Baxter, all of Tenn.

[73] Assignee: Porelon, Inc., Cookeville, Tenn.

[21] Appl. No.: 712,125

[22] Filed: Jun. 7, 1991

[51] Int. Cl.[5] ..... B41K 1/42

[52] U.S. Cl. ..... 428/36.5; 428/36.9; 428/158; 428/206; 428/327; 428/317.3; 428/317.9; 428/315.5; 428/321.3; 521/75; 101/333

[58] Field of Search ..... 521/73, 75; 428/327, 428/206, 36.9, 36.91, 36.92, 36.5, 158, 906, 316.6, 317.3, 317.9, 315.5, 321.3; 101/327, 328, 329, 333

[56] References Cited

U.S. PATENT DOCUMENTS

| | | | |
|---|---|---|---|
| 2,777,824 | 1/1957 | Leeds | 521/52 |
| 3,055,297 | 9/1962 | Leeds | 521/52 |
| 3,141,407 | 7/1964 | Leeds | 521/73 |
| 3,297,803 | 1/1967 | Meisel, Jr. et al. | 264/84 |
| 3,971,315 | 7/1976 | Hansen | 101/333 |
| 4,028,286 | 6/1977 | Neri et al. | 521/73 |
| 4,232,076 | 11/1980 | Stetson et al. | 428/158 |
| 4,306,498 | 12/1981 | Fujimura | 101/333 |
| 4,423,161 | 12/1983 | Cobbs, Jr. et al. | 521/73 |
| 4,768,437 | 9/1988 | Piepmeier, Jr. et al. | 101/327 |
| 4,927,695 | 5/1990 | Ooms et al. | 428/159 |
| 4,956,222 | 9/1990 | Matsuura | 521/73 |

*Primary Examiner*—Ellis P. Robinson
*Assistant Examiner*—Rena L. Dye
*Attorney, Agent, or Firm*—Foley & Lardner

[57] ABSTRACT

An ink roll made of a microporous thermoplastic structure impregnated with an ink has sufficient strength, toughness and flexibility to deliver ink to a transfer roll without substantial misting of the ink from the ink roll surface as the ink roll is driven by a drive roll at peripheral speeds of 200 ips or more. The microporous plastic structure of the roll may be formed from a blend of a first polymer having particles sizes in the range of 1 to 100 μm, and a second polymer having particles sizes from more than 100 μm to 600 μm. The second polymer is selected to impart greater strength and abrasion resistance to the roll than the first polymer. Both of the first and second polymers may be copolymers of PVC and polyvinyl acetate. The second copolymer has more acetate groups than the first polymer, giving it significantly greater strength.

13 Claims, 1 Drawing Sheet

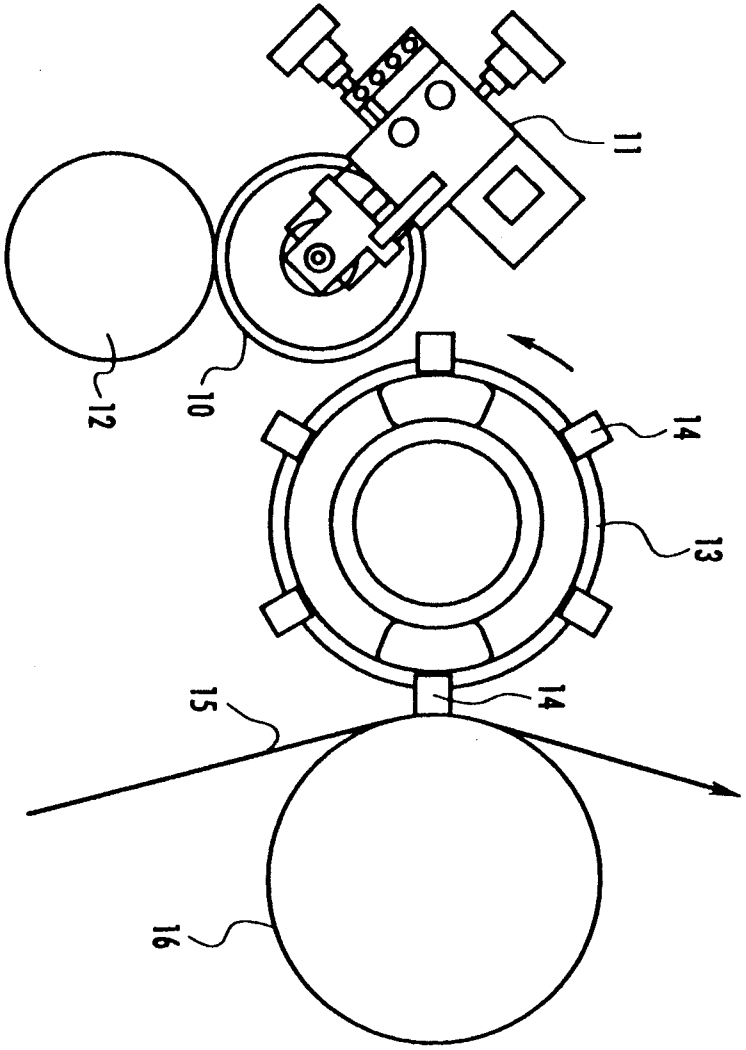
11
14
13
14
10
12
15
16

INK ROLL FOR HIGH SPEED PRINTING

FIELD OF THE INVENTION

This invention relates to ink-impregnated microporous rolls for use ink transfer devices, particularly for use in high speed printing operations.

BACKGROUND OF THE INVENTION

Leeds U.S. Pat. Nos 2,777,824 and 3,055,297 disclose marking structures made of highly porous plastic material, the pores of which are of microscopic proportions and are filled with a marking fluid such as an ink. Structures made in accordance with the teachings of the Leeds patents have experienced a high degree of commercial success as hand stamps, stamp pads, and also as ink rolls such as are used for applying ink to printing members in automatic printing equipment. Such structures are advantageous because of their long life, both in length of time and in numbers of operations or impressions, and because they operate well without the necessity of repetitive re-inking of the marking surface. As ink rolls sold under the trademark Porelon®, such structures provide uniform inking of printing members and exhibit fast recovery to facilitate repetitive use over long periods of time.

A variety of different ink roll structures, microporous foam materials and processes for making such materials are known. Some, for example, feature a bilayered approach wherein one of the layers acts as an ink reservoir. See Hansen U.S. Pat. No. 3,971,315, issued Jul. 27, 1976 and Fujimura U.S. Pat. No. 4,306,498, issued December, 1981. Copolymers of polyvinyl acetate and polyvinyl chloride (PVC) have been used as an ink impregnated material for use in hand stamps. See Ooms et al. U.S. Pat. No. 4,927,695, issued May 22, 1990. Ink rolls have been prepared by a variety of different methods, including a salt leaching process (Piepmeier, Jr., et al. U.S. Pat. No. 4,768,437, issued Sep. 6, 1988) and explosion reticulation (Meisel, Jr. et al. U.S. Pat. No. 3,297,803, issued Jan. 10, 1967.)

Conventional printing systems have difficulty with sequential numbering and imprinting operations wherein a limited area of a printed signature must be printed with a unique number or message, such as the code number of a coupon. Microporous ink rolls have not been used in high speed printing presses because the high rotational speeds involved cause the ink roll to "mist", i e., centrifugal forces cause the ink roll to release droplets of the ink into the air. Known ink rolls also lack sufficient strength and other physical characteristics to perform at high speeds for extended periods. The present invention addresses these problems by providing an improved microporous ink roll capable of performing at high rotational speeds.

SUMMARY OF THE INVENTION

An ink roll according to the invention is made of a microporous thermoplastic structure impregnated with an ink. The ink roll has sufficient strength, toughness and flexibility to deliver ink to a transfer roll without substantial misting of the ink from the ink roll surface as the ink roll is driven by a drive roll at a peripheral speed of at least 200 inches per second (ips). According to one aspect of the invention, this is made possible by preparing the microporous plastic structure from a blend of a first polymer having particles sizes in the range of 1 to 100 μm, and a second polymer having particles sizes from more than 100 μm to 600 μm. The second polymer is selected to impart greater strength and abrasion resistance to the roll than the first polymer. Both of the first and second polymers may be copolymers of PVC and polyvinyl acetate. The second copolymer has more acetate groups than the first polymer, giving it significantly greater strength.

The invention further provides a process for making an improved ink roll using two thermoplastic polymers having different particles sizes as described above. The process involves basic steps of filling a mold with a plastisol premix containing an ink, a plasticizer, and the first and second thermoplastic polymers, and heating the premix-filled mold to fuse the thermoplastic polymers into a microporous, ink-impregnated structure.

BRIEF DESCRIPTION OF THE DRAWING

The drawing is a schematic side view of a printing apparatus for sequential numbering in which the ink roll of the invention is used.

DETAILED DESCRIPTION

Ink rolls according to the present invention represent an improved form of the original Porelon® microporous, plastic ink-impregnated material described generally in the foregoing patents to Leeds. As used herein, the term "microporous" means having an open-celled network of small interstices or voids both at the surface of a piece of material and throughout the interior thereof, i.e. remote from its surface. The material has pores small enough to prevent substantial bleed-out (leakage) of a marking fluid, i.e. small enough as to be not normally discernible by the naked eye, yet large enough to permit some flow therein of a marking fluid such as an ink as described hereinafter. The interconnected aggregates form a substantially uniform, unitary cohesive structure which defines a corresponding network of pores. The network of pores contains the marking fluid, e.g. an ink, which is substantially incompatible with (nonsolvent to) the resin.

In the preparation of an ink roll according to the invention, a thermoplastic resin powder is blended with a plasticizer to form a plastisol blend. A marking fluid such as an ink, separately prepared from dyes, pigments, dye solvents and vehicles which are substantially incompatible with the resin, is added to the plastisol blend, preferably in a weight ratio of marking fluid to plastisol blend within the range of about 0.1–1.0.

A wide variety of thermoplastic resins, particularly synthetic resins, can be used in ink rolls of the invention. Resins which fuse at a temperature below the boiling point of the marking fluid which is used therewith should be used Examples of acceptable thermoplastic resins are polyvinyl chloride, polyvinyl acetate, polyvinylidene chloride, polyvinyl butyral, cellulose acetate butyrate, polymethyl methacrylate, polymethyl acrylate, polysulfone, and copolymers and combinations thereof. Highly preferred resins include: polyvinyl chloride, polyvinyl acetate, polyvinylidene chloride, polyvinyl acetate, polyvinylidene chloride, copolymers of vinyl chloride and other ethylenically unsaturated monomers, and combinations thereof. The most preferred resins are copolymers of vinyl chloride and vinyl acetate. However, the specific resin(s) employed must have an unusually high level of strength, elasticity and flexibility, while still metering ink properly at high speeds. The forms of the foregoing resins previously used in ink rolls do not meet these criteria.

Surprisingly, it has been found according to the invention that an ink roll having the desired properties can be made by increasing slightly the amount of certain functional groups in the resin polymer. For this purpose a preferred ink roll according to the invention is made from a plastisol mixture containing both large and small particles, i.e., small plastic particles having sizes in the ranges from about 1-100 μm, especially 1-20 μm, and large particles from 100-600 μm, particularly 200-400 μm. The mix of large and small particles enhances pore formation. In a preferred embodiment, the small particles are made of a first copolymer of PVC and polyvinyl acetate, i.e., a polyvinyl backbone chain wherein 1 in every 10-13 chlorine atoms is replaced with a functional group that enhances the strength, elasticity and abrasion resistance of the resulting plastic, such as an acetate or maleic anhydride group. The first copolymer can contain, for example, from 4 to 5 wt. % of polyvinyl acetate units, as in conventional Porelon material. The second copolymer contains from 6 to 16, usually 7 to 15, and most preferably 10 to 13 wt. % of polyvinyl acetate units. The weight ratio of the first copolymer to the second copolymer is generally in the range of 4:1 to 1:10 to provide an ink roll which displays good inking performance but also has enhanced toughness.

As an alternative, a single copolymer modified with an intermediate amount, e.g., 6-10 wt. %, of the strength and flexibility-enhancing functional group could be used. Other alternatives include a blend of two different polymers, for example, PVC and a polymer such as polyvinyl acetate having the property-modifying functional groups.

The initial mixture used to prepare the roll contains from 15 to 45 wt. %, especially 22 to 34 wt. %, of the resin, 20 to 60 wt. %, preferably 30 to 40 wt. % of the ink, 15 to 50 wt. % plasticizer, and 0.1 to 1 wt. % of optional additives. The resin comprises a blend of the foregoing two copolymers, but other resins having like inking characteristics and physical properties could be employed.

The plasticizer can be any conventional plasticizer useful in combination with the resin selected. The plasticizer is used in an amount of about 40 to 200 percent by weight of the resin. The plasticizer should soften the resin to allow the formation of aggregates which form the marking structures of the invention. Examples of suitable plasticizers for use with polyvinyl chloride, polyvinyl acetate, polyvinylidene chloride, copolymers of vinyl chloride and other ethylenically unsaturated monomers, or combinations thereof, include tricresyl phosphate, dioctyl phthalate, dimethyl phthalate, dibutyl phthalate, butyl benzyl phthalate, trioctyl phosphate. Other acceptable plasticizers for use with specific thermoplastic resins are well-known. The aforementioned Leeds patents list plasticizers useful with a wide variety of thermoplastic resins, many of which are suitable for use in this invention. The contents of Leeds U.S. Pat. Nos. 2,777,824 and 3,055,297 are expressly incorporated by reference herein.

The plasticizer facilitates formation of interconnected aggregates of thermoplastic resin. The aggregates of thermoplastic resin are sintered, that is, joined by heat, to form a cohesive structure. Tricresyl phosphate and butyl benzyl phthalate (Santicizer 160) are preferred for use with PVC-polyvinyl acetate copolymers. Useful additives include an air removing agent, such as trimethyl silane, and a commercially available surface tension reducing agent (Fluorad FC-430.)

The ink may be any of a variety of conventional pigment and dye-based inks suitable for use in thermoplastic microporous ink rolls. As is known the art, the ink must be incompatible with (non-solvent to) the thermoplastic resin used in the sense that such fluids must not substantially soften or dissolve such resins Inks are normally prepared from dyes, pigments, and dye solvents and vehicles. Examples of solvents and vehicles include aliphatic hydrocarbons, castor oil esters, diethanolamides, fatty acids, fatty acid esters, glyceryl esters, glycols, glycol esters, marine oils, mineral oils, polyethylene and polypropylene glycols, and vegetable oils.

Dyes are generally used in such inks in amounts of from about 10 to 50 wt. %, preferably 5 to 40 percent of total ink weight. The dyes, of course, must be soluble in the dye solvent used. Color pigments are normally dispersed in the vehicles used in amount of from about 2 to 50 percent of total ink weight. Particle sizes of the pigments must be small enough to pass through the micropores of the marking structure.

In high speed printing operations, the ink must meter out at the required speed, wet the printing surface, and then dry rapidly once printed. For this purpose diol and glycol-based inks are preferred for use in the ink rolls of the invention. In such inks the glycol or diol, such as mono-, di-, tri- or tetraethylene glycol, propylene glycol, 1,4-butanediol, 1,5-pentanediol, 2-ethyl-1,3-hexanediol, glycerine, and the like, acts as a dye solvent. The solvent is preferably used in combination with a vehicle such as a fatty acid ester which is liquid at room temperature. The latter include esters of oleic, ricinoleic, isostearic, linoleic, and linolenic acids, among others, such as pentaerythritol monoricinoleate (Polycin 12) and glycerol monoricinoleate. The fatty acid esters are generally compatible with the dye solvents and plasticizers, and serve to help deliver the ink from the microporous roll structure. Like the solvent, these esters should have high boiling points to reduce vapor loss during processing. The fatty acid ester may comprise 10-60 wt. %, preferably 10-40 wt. % of the ink formula.

A pigment may be added to the ink to supplement the dye. Some preferred dyes, such as Basic Blue 7, have good solubility but poor light resistance. Thus, a dispersion of a pigment such as iron blue, preferably dispersed in a portion of one of the fatty acid esters described above, is added to the ink formulation. The amount of the pigment is from 1 to 20 wt. % of the total ink composition.

The dye and/or pigment is chosen in accordance with the desired color and density of the image to be printed. Inks according to the invention preferably have a viscosity in the range of 500 to 20,000 cps, particularly 2000 to 7000 cps, and a density of from 5 to 12 pounds per gallon, preferably 8 to 9 pds/gal.

The ink roll of the invention is prepared by first formulating the ink, and then combining the ink with the resin, plasticizer and other additives to form a premix. The premix is poured into a cylindrical mold with a core and then heated to an elevated temperature at which the plastic particles fuse to form a microporous mass. The roll is then allowed to cool and stabilize.

The ink roll may then be mounted on a suitable sleeve, such as a tubular metal bushing which is mountable by its cylindrical inner surface to a suitable hub.

The outer surface of the sleeve may be knurled or provided with a pattern of grooves, projections or the like to increase the amount of surface area available for bonding to the inner cylindrical surface of the ink roll. The roll surface may then be anodized or chromate-converted to enhance bonding between the adhesive and the sleeve, which is generally made of aluminum. A suitable adhesive such as an epoxy is then used to secure the roll to the sleeve using known techniques, such as aperture bonding or freeze bonding. In the former, the roll is fitted in a stretched condition over a tube having a greater diameter than the sleeve. The tube is then positioned over the epoxy-coated outer surface of the sleeve, and the tube is removed suddenly to bring the roll into contact with the adhesive.

The completed roll preferably has a diameter of at least about 4 inches, preferably at least 6 inches, typically from 6 to 8 inches, and an internal diameter of from 4 to 5 inches. Roll size is important because printing operations require rotation of the ink roll at peripheral speeds of 200 ips or more, generally from 200 to 600 ips, referring to the distance travelled by a point on the outer periphery of the roll in a second. Increasing the diameter of the roll reduces the rotational velocity of the roll at such ips levels and helps prevent the ink roll from misting, i e., throwing out excessive amounts of fine ink droplets into the air.

The ink roll is about 14 to 54 wt. % ink (and a small amount of residual plasticizer), with the balance plastic and absorbed plasticizer. Roll porosity ranges from about 30 to 60%, preferably 30 to 40%, measured as percentage of voids relative to total roll volume. Excessive porosity reduces the strength of the roll, whereas insufficient porosity prevents sufficient ink flow. A roll having an average pore size of from about 0.5 to 100 microns in diameter functions well in this invention, although any properly selected pore size or distribution relative to the viscosity and ability of the fluid to wet the material may be suitably selected by those skilled in the art.

Unlike known ink rolls, the ink roll according to the invention has enhanced toughness and elasticity. Surprisingly, it has been found that the misting problem can largely be suppressed, without substantially changing the porosity or pore size distribution of the roll, by increasing the toughness of the roll.

In printing operations, with reference to the drawing, the ink roll 10 supported for rotation by a movable bracket assembly 11 is driven by a drive roll 12 which is in tangential contact with ink roll 10. Drive roll 12 and/or a transfer roll, such as a numbering wheel 13 having numbering heads 14, exerts pressure on ink roll 10. Heads 14 imprint a web 15 which is in contact with an impression cylinder 16.

The pressure exerted in ink roll 10 is enhanced by the high speed at which ink roll 10 is rotating. Drive roll 12 compresses the softer ink roll 10 like a sponge, forcing ink to the roll surface, which ink is then thrown into the air by centrifugal force. The pressure can also distort the pore structure within the roll.

The present invention solves these problems by increasing the toughness of the roll, thereby decreasing the extent to which it distorts under pressure, yet maintaining needed flexibility. The following Table 1 compares these properties for a standard commercially available Porelon roll and a roll of the invention, wherein preferred ranges are in parentheses:

TABLE 1

| Property | Prior Porelon Ink roll | Invention Ink roll |
|---|---|---|
| Surface penetration strength | 6–9 mm | Less than 6; (4 up to 5.9) |
| Cross penetration strength | 7–10 mm | 3.5 to 6.5 mm |
| Instron tensile strength | 14–40 pds | At least 60 pds; (60 to 300 pds) |
| Durometer | 10–20 | 8–30 (13–15) |

As the table indicates, the roll according to the invention has about the same degree of flexibility as the prior Porelon ink roll, as indicated by a comparable durometer (Shore Durometer, ASTM 2240). However, it has at least 50% greater tensile strength than the prior roll, and also substantially greater resistance to compression as indicated by surface and cross penetration testing. In the latter tests, a standard SUR-Penetrometer PNR 8 is used with a 100 gram weight, and the distance the test needle (ASTM Spec. D5) penetrates the roll on its circumferential surface (radial direction) or side (axial direction) at 77° F. is measured. As the ranges of Table 1 suggest, enhanced roll toughness is needed to suppress misting, but excessive hardness would interfere with ink flow and should be avoided.

EXAMPLE

An ink with a total weight of 100 grams having the following formulation was first prepared:

| | |
|---|---|
| 1,5-pentanediol | 20 wt. % |
| Polycin 12 | 27 wt. % |
| Pigment dispersion | 25 wt. % |
| Coconut oil amide | 8 wt. % |
| Basic Blue 7 (dye) | 10 wt. % |
| 40 oil | 10 wt. % |

The 40 oil (polymerized castor oil) was added as a viscosity builder. The pigment dispersion comprised 30 wt. % of iron blue pigment in Polycin 12.

All ingredients except the dye and pigment dispersion were heated to a temperature in the range of 140°–150° F. The dye was then slowly added, and the mixture held at 140°–150° F. for 30 minutes. The resulting mixture was then heated to a temperature in the range of 220°–230° F. and held at that temperature for 10 minutes. The pigment dispersion was then added, and the mixture was then blended and cooled.

A premix composition having the following formulation and a total weight of 100 gm was then prepared by combining the ink with the other ingredients below:

| | |
|---|---|
| Ink | 35.8 wt. % |
| Fluorad FC-430 | 0.2 wt. % |
| Airout (air remover) | 0.2 wt. % |
| Tricresyl phosphate | 10 wt. % |
| Santicizer 160 | 25.8 wt. % |
| Tenneco 0565 VC/VA Copolymer | 16 wt. % |
| VYNS-3 Resin VC/VA Copolymer | 12 wt. % |

The Tenneco copolymer represented the first copolymer described above which formed 1–20 μm particles, and the VYNS-3 resin represented the second PVC-polyvinyl acetate copolymer having the greater amount of acetate groups as described above and forming 200–400 μm particles.

All ingredients except the ink and air remover were weighed out and combined in a mixer and blended for 10 minutes at room temperature. The ink and air remover were then added, and the mixture was blended for 10 more minutes to complete the premix.

The premix was then poured into a mold and fused at 280° F. for 35 minutes by placing the closed mold into a hot oil bath. Thereafter, the mold was removed and immersed in a quenching bath which was at approximately room temperature. The mold was then removed. The resulting ink roll had an outer diameter of 6.2 inches and an inner diameter of 4.45 inches. The roll was then placed on a stabilization rack and allowed to stand for 16–100 hours, then at 120° F. for 16–18 hours, and finally blotted by rolling on absorbent newspaper to remove excess ink. About 10–30 wt. % of the initial amount of ink is removed by this procedure.

The finished ink roll, which may be cut to a desired width, was bonded to the outer surface of a 4.5 inch OD, 2 inch wide aluminum sleeve. The outer circumferential surface of the sleeve was knurled with two sets of criss-crossing parallel grooves each at an oblique angle relative to the axis of the roll. The grooves subdivided the surface into small, diamond-shaped projections. This outer surface was subjected to a chromate treatment, i.e., electrodeposited with a thin chromium coating (less than 0.005 inch thick) and an epoxy adhesive, a 2-part aliphatic, phenolic, polyamine-activated epoxy resin, was then painted thereon. The painted sleeve was then chilled in a freezer to a temperature of −80° F. and allowed to freeze. The frozen sleeve was then removed from the freezer and force-fitted into the internal diameter of the ink roll. Upon reheating to room temperature, the adhesive permanently bonds the ink roll to the sleeve. The resulting assembly is ready for mounting onto the hub of a support bracket as shown in the drawing.

It will be understood that the foregoing description is of preferred exemplary embodiments of the invention, and that the invention is not limited to the specific forms shown For example, microporous marking structures according to the invention may be used in applications other than ink rolls, such as hand stamps, and in any printing system wherein high speed ink rolls are used as the inking member. These and other modifications may be made without departing from the scope of the invention as expressed in the appended claims.

We claim:

1. An ink roll, comprising a roll consisting essentially of a microporous thermoplastic structure of interconnected aggregates forming substantially uniform, unitary cohesive structure, and an ink impregnated in the microporous structure, wherein the microporous thermoplastic structure is made from a resin which consists essentially of a blend of a first polymer having particle sizes in the range of 1 to 100 μm, and a second polymer having particle sizes from more than 100 μm to 600 μm, the second polymer having a composition different from the first polymer that imparts greater strength and abrasion resistance to the roll than the first polymer, which resin has been plasticized and fused in the presence of a plasticizer to form of an open-celled network of pores both at its surface and throughout its interior, the pores being small enough to prevent substantial leakage of an ink but large enough to permit ink flow to the microporous roll surface, whereby the thermoplastic structure, when the ink roll is rotatably mounted on a bracket in tangential contact with a drive roll and a transfer roll, has sufficient strength, toughness and flexibility to deliver an ink from its outer peripheral surface to the outer peripheral surface of the transfer roll without substantial misting of the ink from the ink roll surface as the ink roll is driven under pressure from tangential contact with the drive roll at a peripheral speed of at least 200 ips.

2. The ink roll of claim 1, wherein both of the first and second polymers are copolymers of PVC and polyvinyl acetate, and the second copolymer has more acetate groups than the first copolymer.

3. The ink roll of claim 2, wherein the first copolymer has from 4 to 5 wt. % of polyvinyl acetate units and the second copolymer has from 6 to 16 wt. % polyvinyl acetate units, and the weight ratio of the first copolymer to the second copolymer is in the range of 4:1 to 1:10.

4. The ink roll of claim 3, wherein the plasticizer is selected from tricresyl phosphate, dioctyl phthalate, dimethyl phthalate, dibutyl phthalate, butyl benzyl phthalate, and trioctyl phosphate, and the ink consists essentially of a dye, a glycol or diol in an amount effective as a solvent, and a fatty acid ester in an amount effective as a vehicle, and has a viscosity in the range of from 2,000 to 7,000 cps.

5. The ink roll of claim 1, wherein the plasticizer is selected from tricresyl phosphate, dioctyl phthalate, dimethyl phthalate, dibutyl phthalate, butyl benzyl phthalate, and trioctyl phosphate, and the ink consists essentially of a dye, a glycol or diol in an amount effective as a solvent, and a fatty acid ester in an amount effective as a vehicle, and has a viscosity in the range of from 500 to 20,000 cps.

6. The ink roll of claim 1, wherein the first polymer has particle sizes in the range of 1 to 20 μm, and the second polymer has particle sizes of from 200 μm to 400 μm.

7. The ink roll of claim 1, wherein the ink roll has a surface penetration strength of from 4 up to 5.9 mm and a cross penetration strength of 3.5 to 6.5 mm as measured by a penetrometer using a 100 gram weight at 77° F., an instron tensile strength of from 60 to 300 pds, and a durometer in the range of 8–30.

8. The ink roll of claim 1, wherein the microporous roll has a cylindrical shape and has an outer diameter of at least about 4 inches, and further comprises a tubular bushing and means for securing the outer periphery of the bushing to the inner periphery of the cylindrical microporous roll.

9. An ink roll, consisting essentially of:

a microporous roll made of a thermoplastic resin which consists essentially of a blend of a first polymer having particle sizes in the range of 1 to 20 μm, and a second polymer having particle sizes of from 200 μm to 400 μm, wherein both of the first and second polymers are copolymers of PVC and polyvinyl acetate, and the second polymer has more acetate groups than the first polymer so that the second polymer imparts greater strength and abrasion resistance to the roll than the first polymer, wherein the resin has been plasticized and fused in the presence of a plasticizer to form interconnected aggregates forming a substantially uniform, unitary cohesive structure which defines a corresponding open-celled network of small pores both at the surface of the microporous roll and throughout its interior, which pores are small enough to prevent substantial leakage of an ink but large enough to permit ink flow to the microporous roll surface; and an ink impregnated in the microporous roll;

wherein the ink roll contains about 14 to 54 wt. % ink, with the balance plastic and absorbed plasticizer, and the ink roll further has a porosity from about 30 to 60% measured as percentage of voids relative to total roll volume, an average pore size in the range of from about 0.5 to 100 microns, a surface penetration strength of from 4 up to 5.9 mm and a cross penetration strength of 3.5 to 6.5 mm as measured by a penetrometer using a 100 gram weight at 77° F., an instron tensile strength of from 60 to 300 pds, and a durometer in the range of 8–30, such that the ink roll has sufficient strength, toughness and flexibility, when the ink roll is rotatably mounted on a bracket in tangential contact with a drive roll and a transfer roll, to deliver the ink from its outer peripheral sruface to the outer peripheral surface of the transfer roll without substantial misting of the ink from the ink roll surface as the ink roll is driven under pressure from tangential contact with the drive roll at a peripheral speed of at least 200 ips.

10. The ink roll of claim 9, wherein the first copolymer has from 4 to 5 wt. % of polyvinyl acetate units and the second copolymer has from 6 to 16 wt. % polyvinyl acetate units, and the weight ratio of the first copolymer to the second copolymer is in the range of 4:1 to 1:10.

11. The ink roll of claim 10, wherein the plasticizer is selected from tricresyl phosphate, dioctyl phthalate, dimethyl phthalate, dibutyl phthalate, butyl benzyl phthalate, and trioctyl phosphate, and the ink consists essentially of a dye, a glycol or diol in an amount effective as a solvent, and a fatty acid ester in an amount effective as a vehicle, and has a viscosity in the range of from 2,000 to 7,000 cps.

12. The ink roll of claim 9, wherein the plasticizer is selected from tricresyl phosphate, dioctyl phthalate, dimethyl phthalate, dibutyl phthalate, butyl benzyl phthalate, and trioctyl phosphate, and the ink consists essentially of a dye, a glycol or diol in an amount effective as a solvent, and a fatty acid ester in an amount effective as a vehicle, and has a viscosity in the range of from 500 to 20,000 cps.

13. The ink roll of claim 9, wherein the microporous roll has a cylindrical shape and has an outer diameter of at least about 4 inches, and further comprises a tubular bushing and means for securing the outer periphery of the bushing to the inner periphery of the cylindrical microporous roll.

* * * * *